US005279508A

United States Patent [19]

Lee

[11] Patent Number: 5,279,508

[45] Date of Patent: Jan. 18, 1994

[54] SHIFTING CONNECTION DEVICE

[76] Inventor: Ching-san Lee, 3rd. Floor, No. 5, Alley 1, Lane 96, Ming-chuan Road, Lu-chou, Taipei Hsien, Taiwan

[21] Appl. No.: 939,985

[22] Filed: Sep. 3, 1992

[51] Int. Cl.[5] ..... H01R 17/00

[52] U.S. Cl. ..... 439/660; 439/741

[58] Field of Search ..... 439/660, 692, 682, 741-747, 439/871-873, 79, 638, 651, 654, 655, 676

[56] References Cited

U.S. PATENT DOCUMENTS

| | | | |
|---|---|---|---|
| 3,757,277 | 9/1973 | Yamanoue et al. | 439/660 |
| 3,950,068 | 4/1976 | Schmieg | 439/660 |
| 3,960,436 | 6/1976 | Minks et al. | 439/660 |
| 4,045,114 | 8/1977 | Dechelette | 439/79 |
| 4,380,119 | 4/1983 | Normann et al. | 439/79 |
| 5,169,330 | 12/1992 | Adlon et al. | 439/218 |

*Primary Examiner*—David L. Pirlot

*Attorney, Agent, or Firm*—Bucknam and Archer

[57] ABSTRACT

A shifting connection device compises a connector and a plurality of conductive spring strips. The connector has a base part with a plurality of sockets and has a supporting board extending out of the base part along the central portion. A plurality of spaced elongated recess positions are provided on the supporting board to be attached by the plurality of conductive spring strips. Each socket in the connector has a wall surface inclining inward near the top of the base part to make the respective outer side of the base part produce an elastic force to press the plurality of conductive spring strips against the plurality of recess sections.

1 Claim, 6 Drawing Sheets

SHIFTING CONNECTION DEVICE

The present invention relates to a novel shifting connection device used in a personal computer and more precisely, the present invention relates to a shifting connection device which may be fabricated much more easily and may connect the disk drive and the main board.

BACKGROUND OF THE INVENTION

Normally, a prior art shifting connection device, as shown in FIG. 1, FIG. 2*a*, FIG. 2*b*, FIG. 2*c*, and FIG. 2*d*, comprises a printed circuit board 1, a connector 2, and a plurality of copper conductive strips 3. The connector 2 is disposed on the printed circuit board 1, having a respective lateral side overlapped with each other. There are a number of sockets located in the connector 2. Each conductive copper strip 3 is made with a 90° bend so that an end part may be inserted into each socket and the other end part may be fixed to the printed circuit board 1, respectively. Therefore, once the printed circuit board 1 connects with the disk drive and the connector 2 connects with the main board, an electrical connection is obtained between the disk drive and the main board. It can be seen in FIG. 2*b* and FIG. 2*c* that each copper conductive strip 3 is fixed to the printed circuit board 1 at the position 4 by means of soft soldering. Also, it can be understood that substantial time is needed to perform the fixing job, and the printed circuit board 1 may be splashed by the melting tin during the fixing process. In order to protect the printed circuit board 1 from the splashed melting tin, further work has to be done, such as a film of protective material coated on the surfaces of the printed circuit board 1 in advance or cleaning the melting tin out of the printed circuit board afterward. From the manufacture point of view, to build a prior art shifting connection device needs much time and substantial labor so that serious deficiencies may arise, such as high production cost and low economical efficiency.

SUMMARY OF THE INVENTION

The shifting connection device according to the present invention comprises a connector integrated with a supporting board 1 and a plurality of conductive spring strips. Each conductive spring strip is disposed on the connector with the lower part clamped in each of the plurality of sockets respectively and the upper portion is attached to the supporting board at either side respectively.

In this way, it is not necessary to provide a circuit board, and it is not necessary to perform the soldering job for fixing the conductive strips to the circuit board. Therefore, the shifting connector device according to the present invention may be easily fabricated and the original function as in the prior art shifting connector device is retained.

An object of the present invention is to provide a new shifting connection device according to which the manufacturing process may be simplified so as to lower the production cost, and the original connection according to the prior art connection device may be maintained.

Another object of the invention is to provide a new shifting connection device in which the conductive spring strips are electrically connected to the signal plugs on the disk drive so that a better conductibility may be obtained, and the chance of break-down caused by an improper contact may be lessened.

BRIEF DESCRIPTION OF THE DRAWING

The present invention is further illustrated, by way of example, with reference to the acompanying drawings, in which.

DETAILED DESCRIPTION OF THE PREFERRED EMBODIMENT

Figure 1:
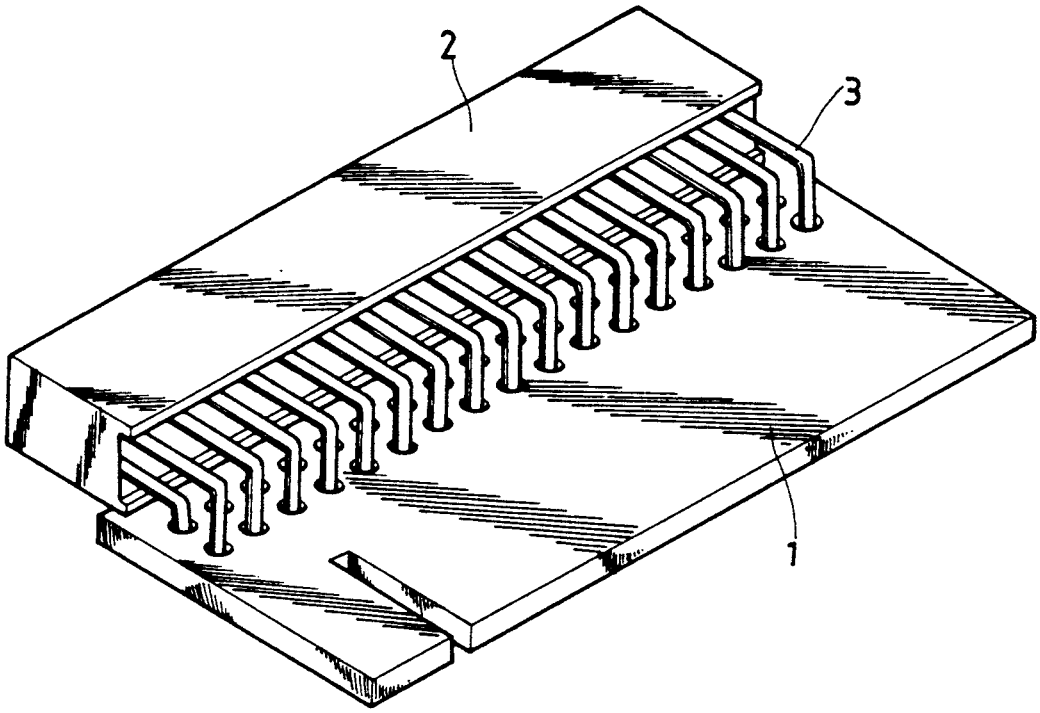
PRIOR ART FIG. 1
FIG. 1 is a perspective view of a prior art shifting connection device.
Figure 2A:
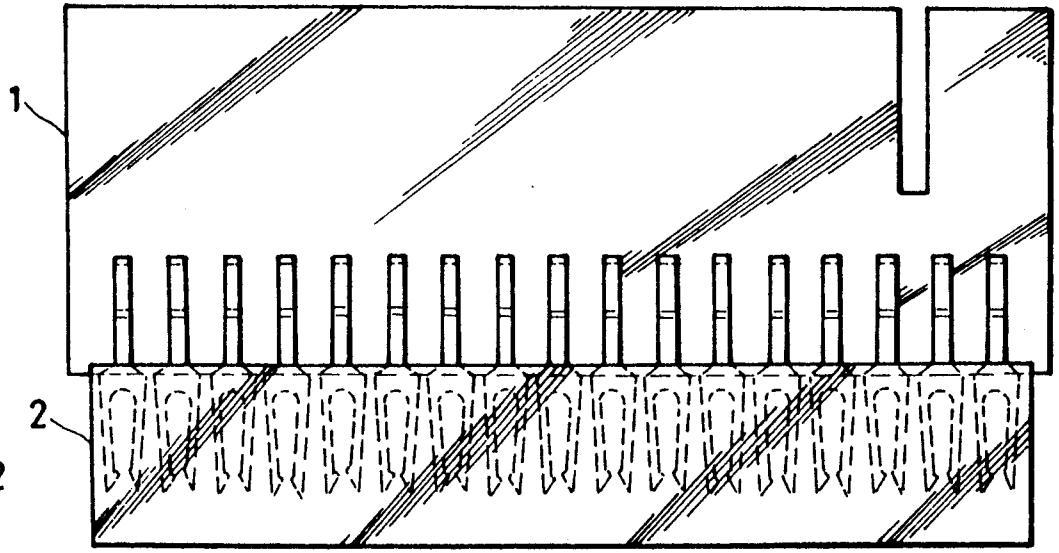
PRIOR ART FIG.2a
FIG. 2*a* is a top view of the prior art shifting connection device shown in FIG. 1.
Figure 2B:
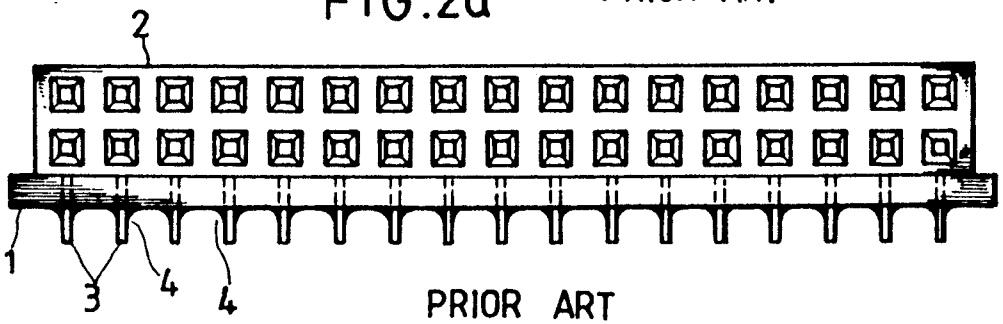
PRIOR ART FIG.2b
FIG. 2*b* is a bottom view of FIG. 2*a;*
Figure 2C:
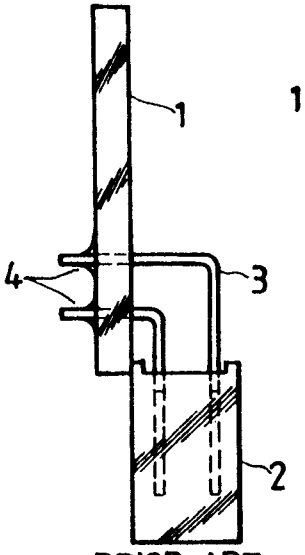
PRIOR ART FIG.2c
FIG. 2*c* is a side view of FIG. 2*a;*
Figure 2D:
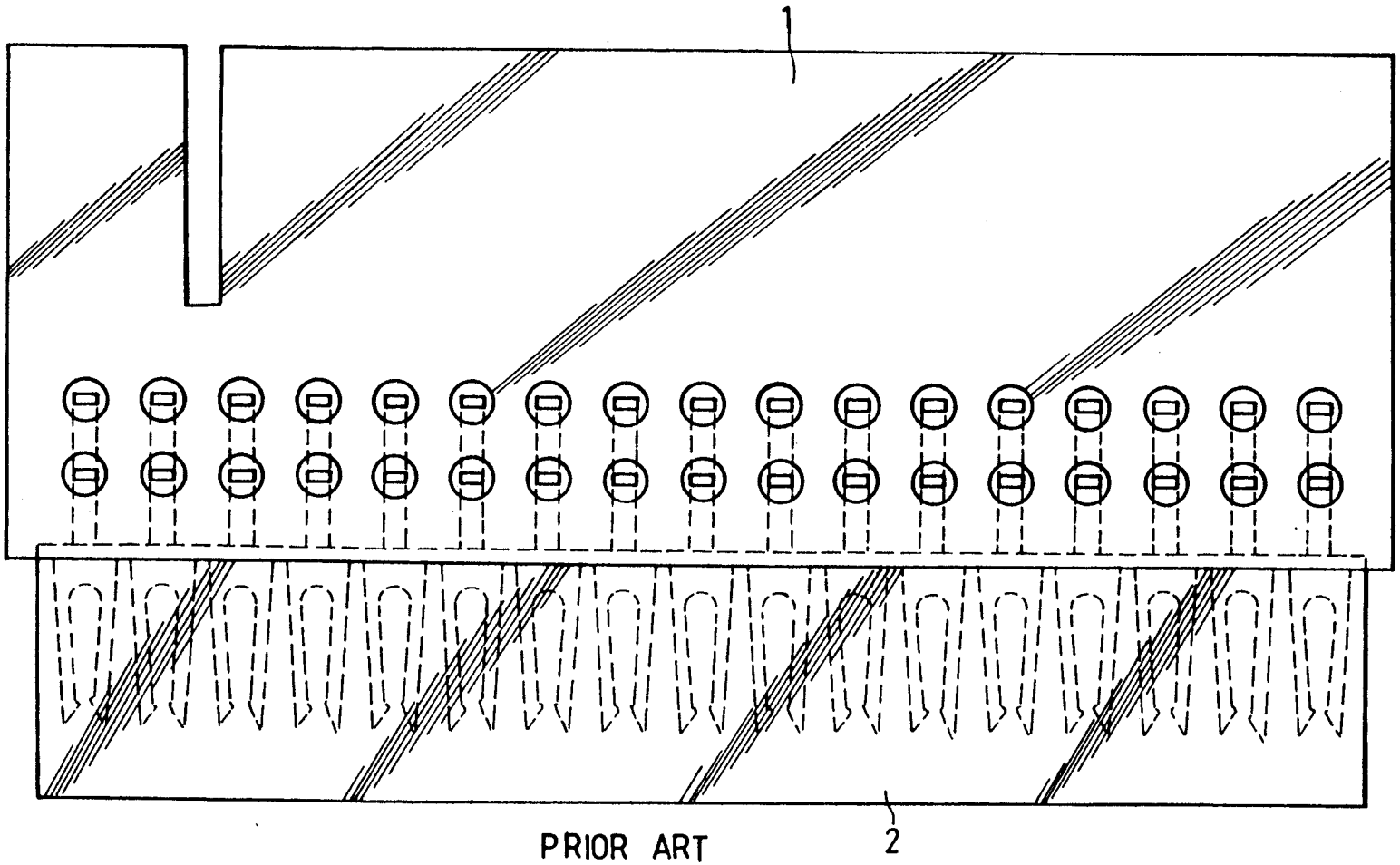
PRIOR ART FIG. 2d
FIG. 2*d* is a back view of FIG. 2*a* with an enlarged scale.
Figure 3:
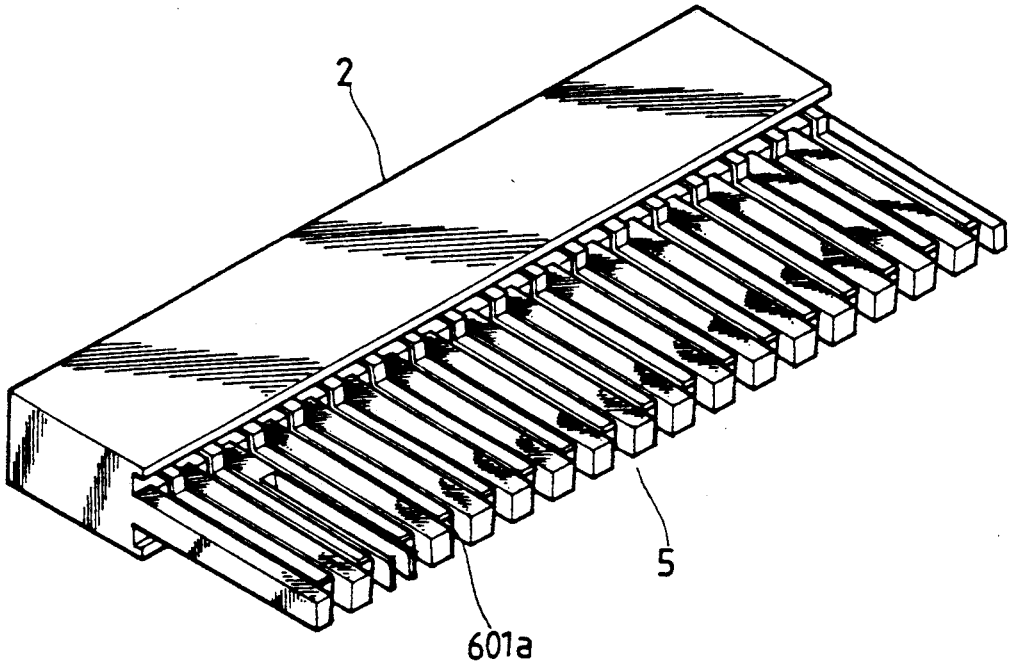
FIG. 3 is a perspective view of an embodiment according to the present invention.

By reference to FIG. 3, FIG. 4*a*, FIG. 4*b* and FIG. 4*d*, the shifting connection device basically comprises a connector 2 and a plurality of conductive spring strips 601*a* and 602*b*. The connector 2 is provided with a plurality of sockets 201*a* and 201*b* at the base part and is fixed to a supporting board 5 extending out of the base part along the central portion. The outer appearance of the plurality of sockets 201*a* and 201*b* is similar to the prior art connector shown in FIG. 2*b*. There are a number of elongated recess sections 701*a* and 702*a* oppositely disposed on either side of the supporting board 5 respectively with adjacent recess sections spacing from each other. Furthermore, the respective locations of the upper recess sections 701*a* and the lower recess sections 702*a* correspond to the respective sockets 201*a* and 201*b*. The respective lower parts of the conductive spring strips 601*a* and 602*a* are the same as the prior art copper strips 3 shown in FIG. 2*a* and FIG. 2*d* and are inserted into each of the sockets. The respective upper parts of the conductive spring strips 601*a* and 602*a* remain attached to the respective recess sections 701*a* and 702*a* on the supporting board.

Figure 4C:
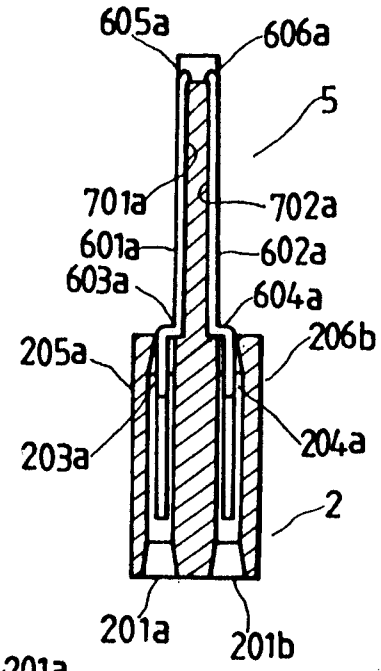
FIG. 4*c* is a cross section view of FIG. 4*a*.
Figure 4A:
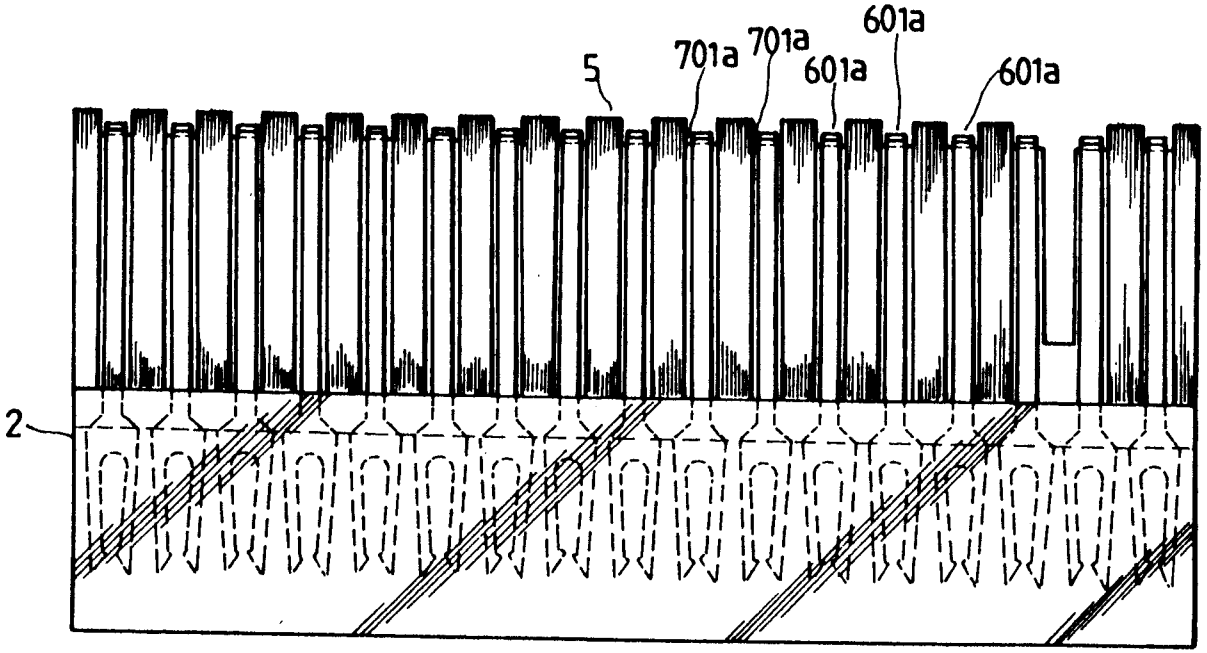
FIG. 4*a* is a top view of FIG. 3.
Figure 4B:
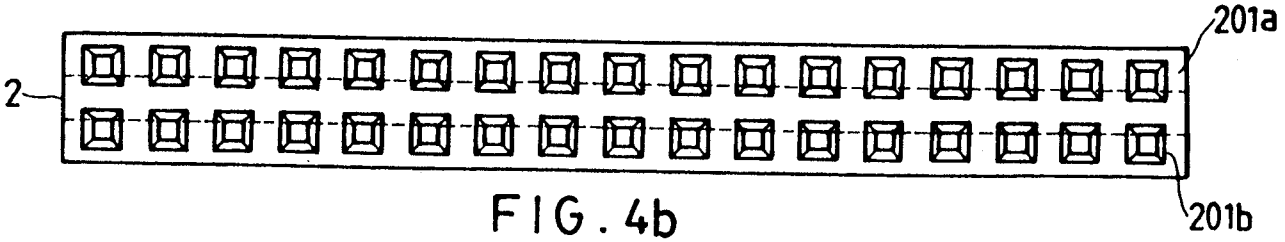
FIG. 4*b* is a bottom view of FIG. 4*a;*
Figure 4D:
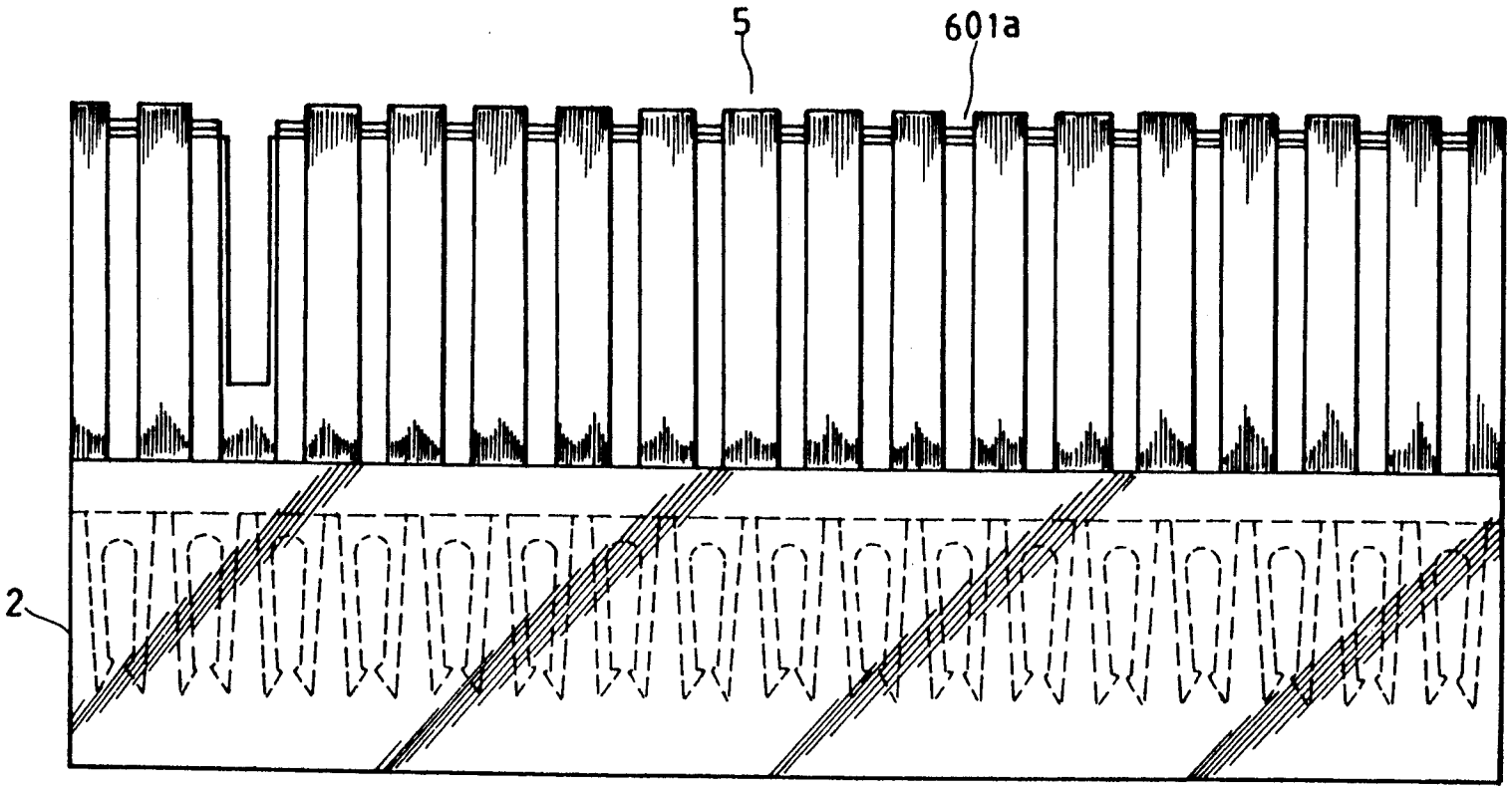
FIG. 4*d* is a rear view of FIG. 4*a* in an enlarged scale.

FIG. 4*c* illustrates the conductive spring strips 601*a* and 602*a* fixed to the connector 2 in detail. The respective lower parts of the conductive spring strips 601*a* and 602*a* are located in the sockets 201*a* and 201*b* respectively. The respective upper parts of the conductive spring strips 601*a* and 602*a* oppositely keep contact with recess sections 701*a* and 702*a* respectively. Each of the conductive spring strips 601*a*, 602*a* has a shoulder 603*a*, 604*a* bent respectively between the lower part and the upper part, and has an end 605*a*, 606*a* also bent respectively to clamp the spring strips 601*a*, 602*a* at the respective recess section 701*a*, 702*a*. The supporting board S in the location of the respective recess sections 701*a*, 702*a* is provided with a length shorter than in other locations. Each of the sockets 201*a*, 201*b* has an inwardly inclined wall 203*a*, 204*a* respectively near the top so that a smaller opening is provided at the top. When the conductive spring strips 601*a*, 602*a* are inserted into the sockets 201*a*, 201*b*, both the outer sides of the base part on the connector 2 are elastically deformed and press against the conductive spring strips 601*a*, 602*a* toward the central portion of the connector 2 so that the respective upper parts of the conductive spring strips 601*a*, 602*a* may keep contact with the recess sections 701*a* and 702*a* tightly.

In practice, the connector 2 in the shifting connection device according to the present invention may be made of a plastic material with the base part integral with the supporting board 5 by means of ejection molding. The conductive spring strips 601*a*, 602*a* may be stamped with a shoulder respectively between the lower part and the upper part by a press machine in advance. Then, the lower parts of the conductive spring strips 601*a*, 602*a* are inserted into the sockets located in the base part of the connector 2 against the resilient force exerted by the outer sides 205*a* and 206*b* respectively. The respective upper ends of both the conductive spring strips 601*a*, 602*a* are bent inward by the press machine to clip the supporting board at the respective recess sections 701*a* and 702*a*. In this way, the shifting connection device according to the present invention may be easily assembled.

It is noted that the supporting board 5 with the conductive spring strips 601*a*, 602*a* has the same thickness same as the print circuit board 1 in the prior art shifting connection device, and the signal plugs in the disk drive may clamp the conductive spring strips 601*a*, 602*a* without any difficulty. Furthermore, the respective locations of the sockets 201*a*, 201*b* for connecting with the main board are unchanged, therefore, the shifting connection device according the present invention still may connect with the main board properly.

I claim:

1. A shifting connecting device made of a plastic material, comprising a connector (2), a supporting board (5) fixed thereto, said connector having a base and a central portion, said supporting board (5) extending from said base along said central portion and having two sides, said connector having a plurality of sockets (201*a*) (201*b*) in said base, a plurality of recess portions (701*a*) (701*b*) located in said two sides of said supporting board (5), the locations of said recess portions corresponding to the location of said sockets, a plurality of conductive spring strips (601*a*) (601*b*) having an upper part and a lower part, during assembly said lower part of each of said spring strips being inserted in each of said sockets, the upper part of each of said spring strips remaining in contact with said recess portions (701*a*) (702*b*), a shoulder (603*a*, 603*b*) being formed between each of said upper parts and each of said lower parts, each of said upper parts having an end (605*a*) (606*a*) inwardly bent to clamp said spring strips to said recess portions (701*a*) (702*b*), said base of said connector having a top and outer sides, each of said sockets having a wall surface inwardly inclined near said top of said base, whereby a smaller opening (203*a*) (204*a*) is provided at said top of said base, and when each of said conductive spring strips is inserted in each of said sockets, said outer sides of said base produce an elastic force and press against said conductive spring strips and the upper part of each of said conductive spring strips remains in firm contact with said recess portions.

* * * * *